US009868299B2

(12) United States Patent
Bastardas Puigoriol et al.

(10) Patent No.: US 9,868,299 B2
(45) Date of Patent: Jan. 16, 2018

(54) HEATING SYSTEM CONTROL

(71) Applicant: Hewlett-Packard Development Company, L.P., Houston, TX (US)

(72) Inventors: Roger Bastardas Puigoriol, Barcelona (ES); Francisco Javier Perez Gellida, Barcelona (ES); Santiago Sanz Ananos, Barcelona (ES); Juan Manuel Valero Navazo, Sant Feliu de Llobregat (ES); Mikel Zuza Irurueta, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/119,963

(22) PCT Filed: Mar. 29, 2014

(86) PCT No.: PCT/US2014/032288

§ 371 (c)(1),
(2) Date: Oct. 17, 2016

(87) PCT Pub. No.: WO2015/130326

PCT Pub. Date: Sep. 3, 2015

(65) Prior Publication Data

US 2017/0057250 A1 Mar. 2, 2017

Related U.S. Application Data

(63) Continuation-in-part of application No. PCT/US2014/031886, filed on Mar. 26, 2014, which
(Continued)

(51) Int. Cl.
*B41J 11/00* (2006.01)
*B41J 29/377* (2006.01)
(Continued)

(52) U.S. Cl.
CPC ..... *B41J 11/002* (2013.01); *B41J 2/01* (2013.01); *B41J 29/377* (2013.01); *H05B 3/00* (2013.01); *H05B 2203/035* (2013.01)

(58) Field of Classification Search
CPC ..... B41J 11/002
See application file for complete search history.

(56) References Cited

U.S. PATENT DOCUMENTS 4,502,056 A 2/1985 Matsuda
4,675,695 A 6/1987 Samuel et al.
(Continued)

FOREIGN PATENT DOCUMENTS

JP JPS58114976 7/1983
JP JPH06314046 11/1994
(Continued)

OTHER PUBLICATIONS

Cochior, C. et al.; Cold Start Control of Industrial Printers ; http://ieeexplore.ieee.org/xpl/articleDetails.jsp?tp=&arnumber=6265982&queryText%3Dprinter+temperature+control ; Jul. 11, 2012.
(Continued)

*Primary Examiner* — Jason Uhlenhake
(74) *Attorney, Agent, or Firm* — HP Inc. Patent Department

(57) ABSTRACT

In one example, a heating system includes a first heater having a first resistive heating element, a second heater having multiple second resistive heating elements arranged in parallel with a group of the second heating elements having a combined resistance equal to a resistance of the first heating element, and a controller to periodically switch power between the first heating element and the group of second heating elements at a zero crossing of an AC power source.

12 Claims, 13 Drawing Sheets

Related U.S. Application Data is a continuation-in-part of application No. PCT/US2014/018689, filed on Feb. 26, 2014.

(51) Int. Cl.
*B41J 2/01* (2006.01)
*H05B 3/00* (2006.01)

(56) References Cited

U.S. PATENT DOCUMENTS

| | | | | |
|---|---|---|---|---|
| 5,089,830 | A | 2/1992 | Cha et al. | |
| 5,239,164 | A * | 8/1993 | Hirota | B41J 11/002 219/485 |
| 5,737,674 | A | 4/1998 | Venkatesan et al. | |
| 5,920,331 | A | 7/1999 | Silverbrook | |
| 6,390,618 | B1 | 5/2002 | Wotton et al. | |
| 6,554,514 | B2 | 4/2003 | Wotton et al. | |
| 6,771,916 | B2 | 8/2004 | Hoffman et al. | |
| 8,275,278 | B2 | 9/2012 | Ishigaya et al. | |
| 8,351,815 | B2 | 1/2013 | Eden et al. | |
| 2009/0027472 | A1 | 1/2009 | Sekiya | |
| 2010/0282910 | A1 | 11/2010 | Stothers et al. | |
| 2011/0036255 | A1 | 2/2011 | Monclus et al. | |

FOREIGN PATENT DOCUMENTS

| | | |
|---|---|---|
| JP | JPH1120144 | 1/1999 |
| JP | 2007121354 | 5/2007 |
| JP | 2009214416 | 3/2008 |
| JP | 2009234103 | 3/2008 |
| JP | 2013149006 | 8/2013 |
| WO | WO2015/130275 | 9/2015 |
| WO | WO2015/130325 | 9/2015 |
| WO | WO2015/130326 | 9/2015 |

OTHER PUBLICATIONS

Crouch, K.G. et al.;The Control of Press Cleaning Solvent Vapors in a Small Lithographic Printing Establishment, http://www.tandfonline.com/doi/abs/10.1080/104732299302918#UnOOF7UcyYQ > On pp. 329-338; Nov. 30, 2010.

Yoneya, A., et al.; Rapid Zero-cross Switch Control of AC Resistive Load with Deep Delta-sigma Modulator, http://ieeexplore.ieee.org/xpl/articleDetails.jsp?tp=&arnumber=6119395&queryText%3Dprevent+flicker+zero+cross+power?share>; Nov. 7-10, 2011.

* cited by examiner

HEATING SYSTEM CONTROL

BACKGROUND

Inkjet printers use printheads with tiny nozzles to dispense ink or other printing fluid on to paper or other print substrates. The temperature of the environment in which an inkjet printer is used can affect the quality of the printed image. Cooler operating environments can adversely affect print quality, particularly for large format printers dispensing water based inks. Water based inks are commonly referred to as "latex" inks. Also, large format printers dispensing higher volumes of latex ink can affect the surrounding environment. Powerful blow driers are often used in latex ink printers to quickly evaporate the moisture in the ink immediately after the image is applied to the print substrate. The moisture in the hot air flowing out of the printer downstream from the dryer may condense into vapor that can produce a noticeable fog, particularly at high print volumes in cooler operating environments.

DRAWINGS

Figure 7:
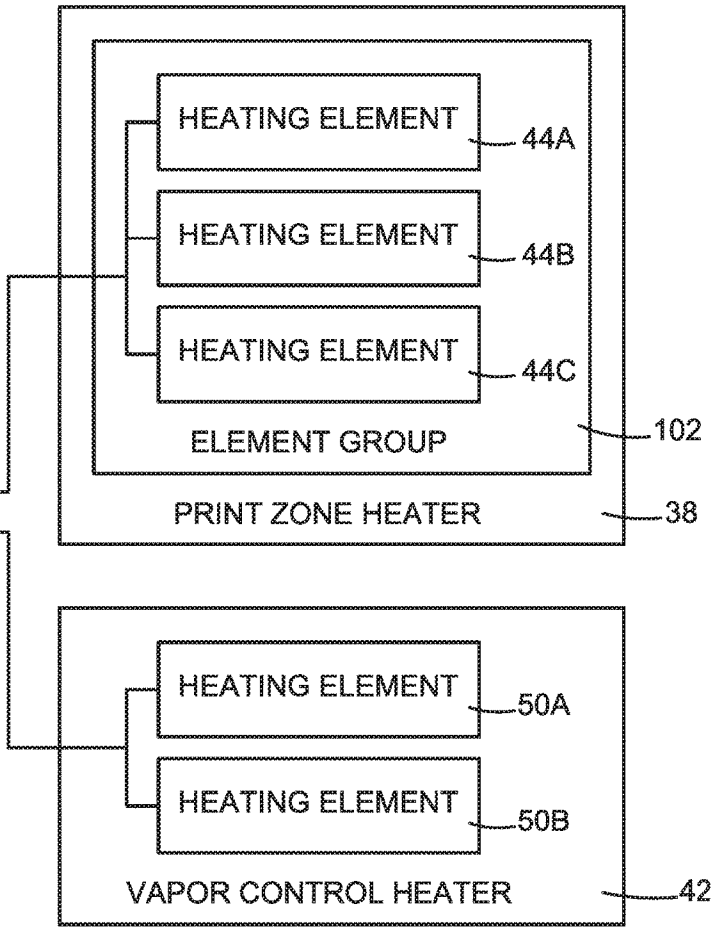
FIG. 7 is a block diagram illustrating one example configuration for the heating elements an air heating system such as that shown in FIGS. 1 and 3.
Figure 9:
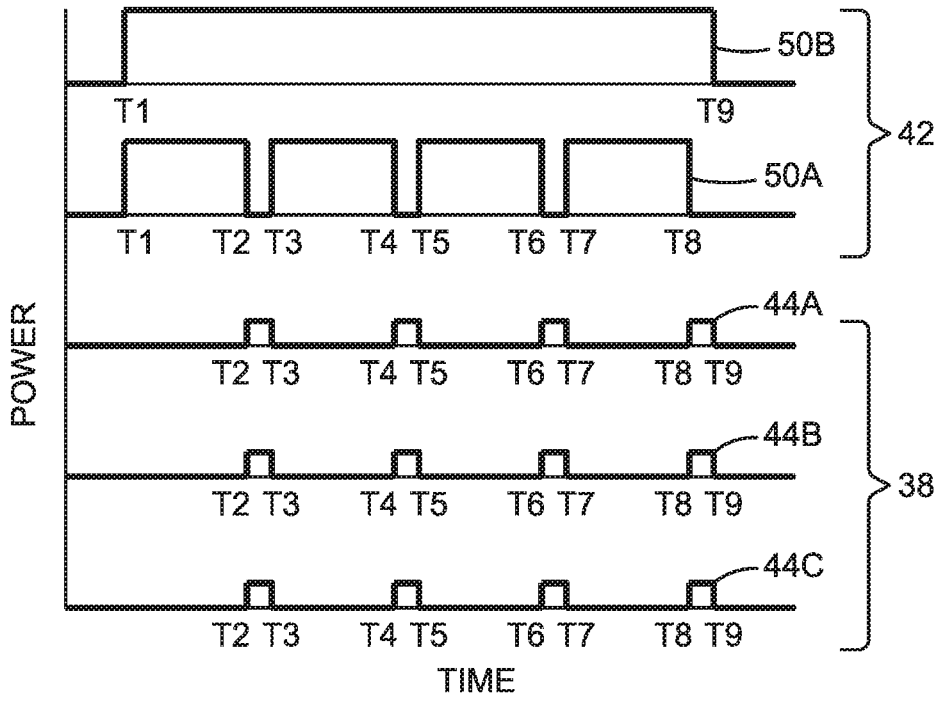

FIG. 9 presents a series of graphs illustrating one example of the individual power consumption of the heating elements during inter-heater power sharing between the print zone and vapor control heaters in the system shown in FIG. 7.

Figure 10:
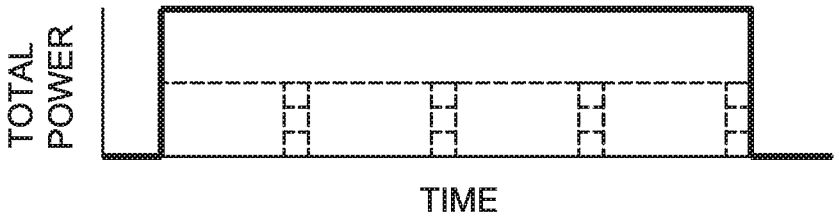

FIG. 10 presents a graph illustrating the collective power consumption corresponding to the individual graphs shown in FIG. 9.

Figure 11:
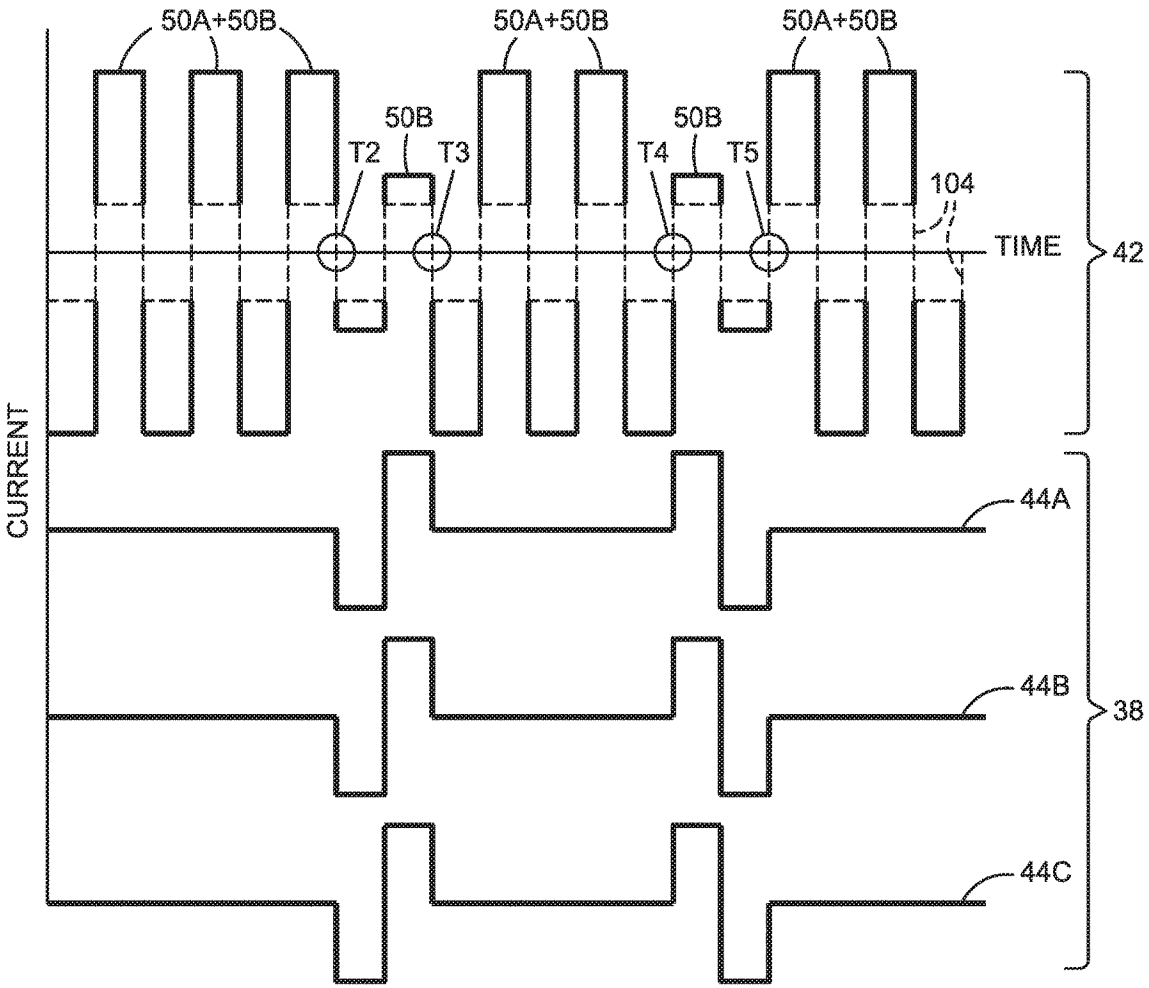

FIG. 11 illustrates one example of current flow during switching for individual heating elements to maintain steady power consumption on an AC power line as shown in FIG. 10.

Figure 12:
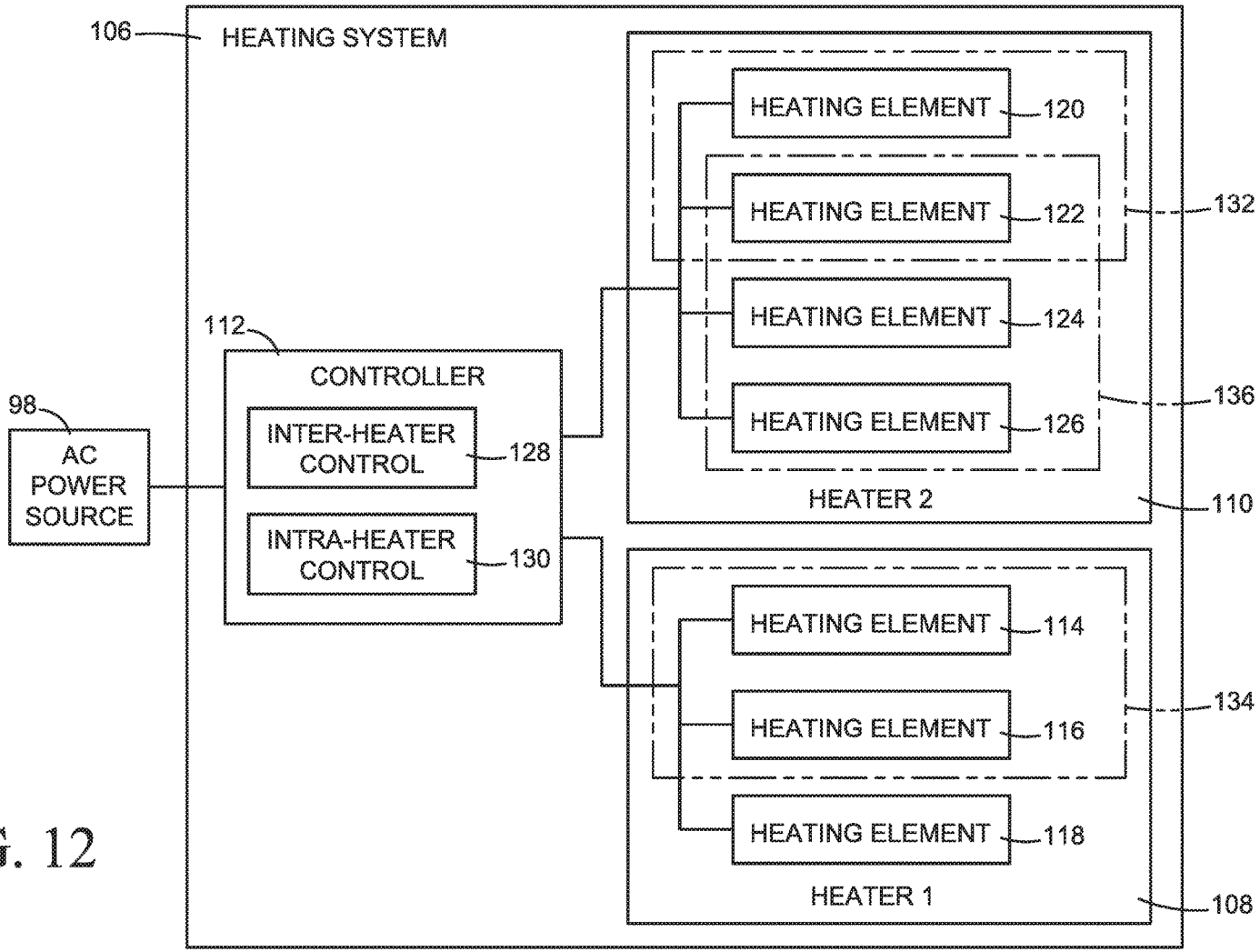

FIG. 12 is a block diagram illustrating one example of a heating system with steady power control.

Figure 13:
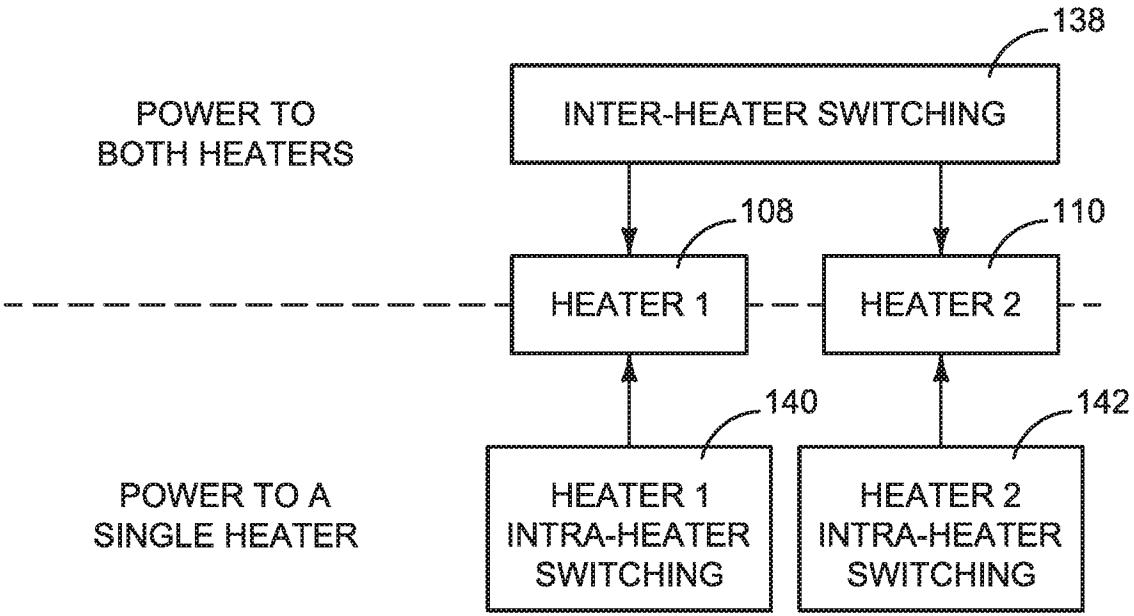

FIG. 13 is a block diagram illustrating one example of a heating system with inter-heater switching when power is shared by multiple heaters and intra-heater switching when power is provided to only one of the heaters.

Figure 14:
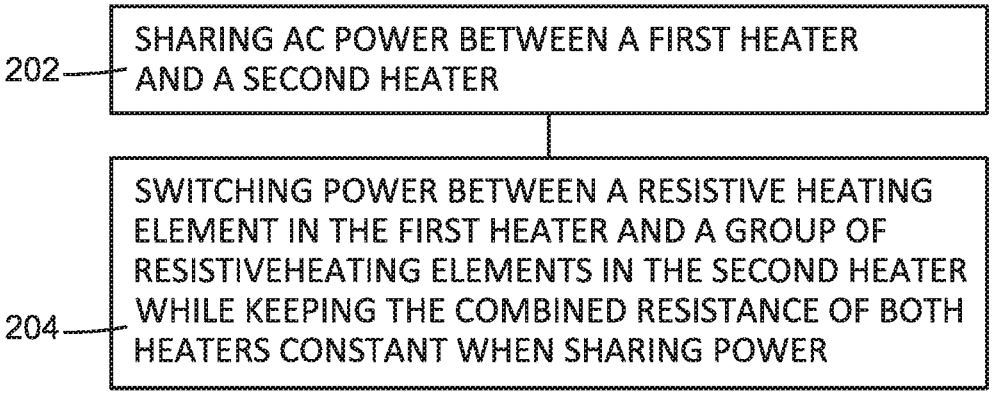
Figure 15:
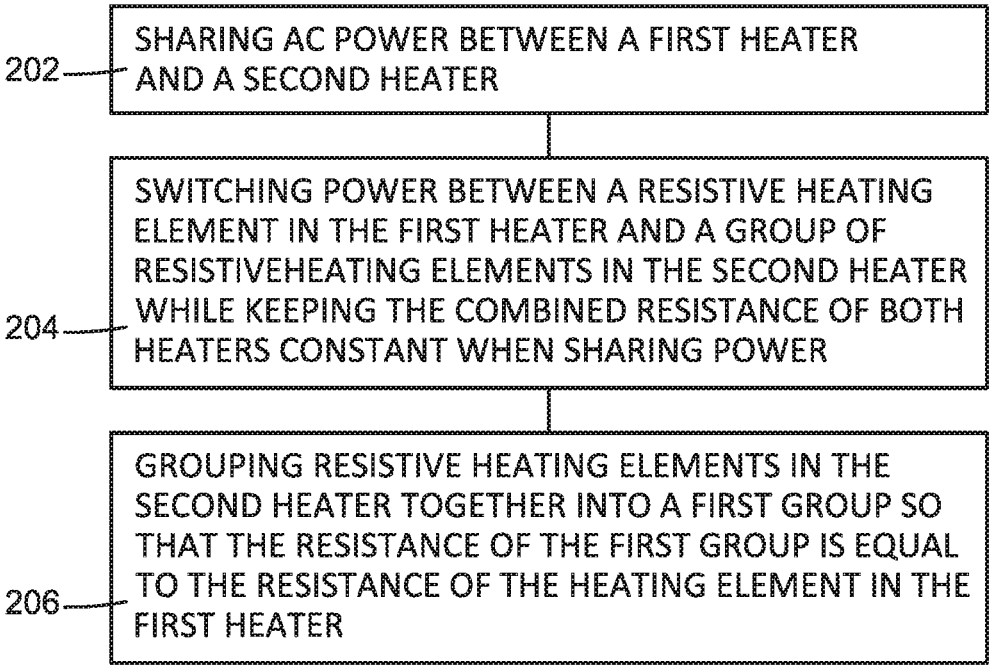
Figure 16:
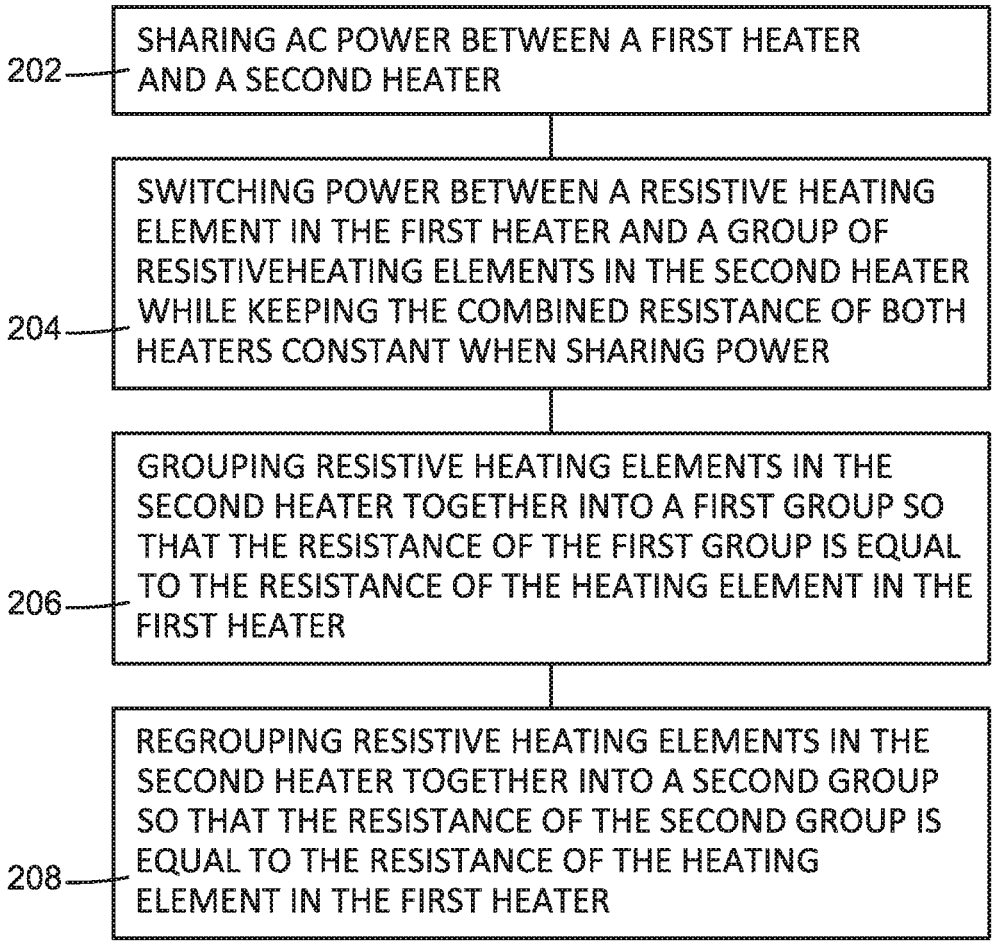

FIGS. 14-16 are flow diagrams illustrating example heating system control processes to maintain uniform power consumption on an AC power line.

The same part numbers designate the same or similar parts throughout the figures.

DESCRIPTION

New heating systems have been developed for large format inkjet printers to help the printers work effectively in cooler operating environments. For example, International Patent Application No. PCT/US14/31886 filed Mar. 26, 2014 discloses a print zone heater that raises the temperature of the print zone to help maintain good print quality in cooler operating environments and a vapor control heater that introduces warm air into the moisture laden air leaving the printer to help reduce the risk of unwanted condensation. The print zone and vapor control heaters utilize resistive heating elements that consume significant amounts of electrical power. A shared AC power line may not have sufficient capacity to power both heaters at the same time under all operating conditions.

While it might be possible to switch power between the print zone and vapor control heaters periodically to stay within the power line budget and still achieve adequate heat output, switching between heaters can cause an unacceptable level of flicker in the AC power line. Accordingly, a new control system has been developed to help reduce flicker in the power line shared by the print zone heater and the vapor control heater. In one example of the new system, the resistance of a group of heating elements in the print zone heater is selected to match the resistance of one of the heating elements in the vapor control heater. Then, the system controller can deliver power simultaneously to both heaters while periodically switching power between the print zone heater group and the vapor control heater element to stay within the power line budget and, by switching at a zero crossing of the AC power source, without causing an unacceptable degree of flicker. Matching the resistance of the switched elements and switching at a zero crossing helps keep the load on the power line steady even as the power distribution changes.

Examples of the new control system are not limited to print zone and vapor control heaters or even to inkjet printers, but may be implemented in other heating systems and for other devices. More generally, for example, a heating system may include a first heater having a first resistive heating element and a second heater having multiple second resistive heating elements arranged in parallel. The heating elements are designed so that the combined resistance of a group of the second heating elements is equal to the resistance of the first heating element. A system controller is programmed to periodically switch power between the first heating element and the group of second heating elements at a zero crossing of the AC power source to maintain uniform power consumption within the power budget.

The examples shown in the figures and described herein illustrate but do not limit the disclosure.

Figure 1:
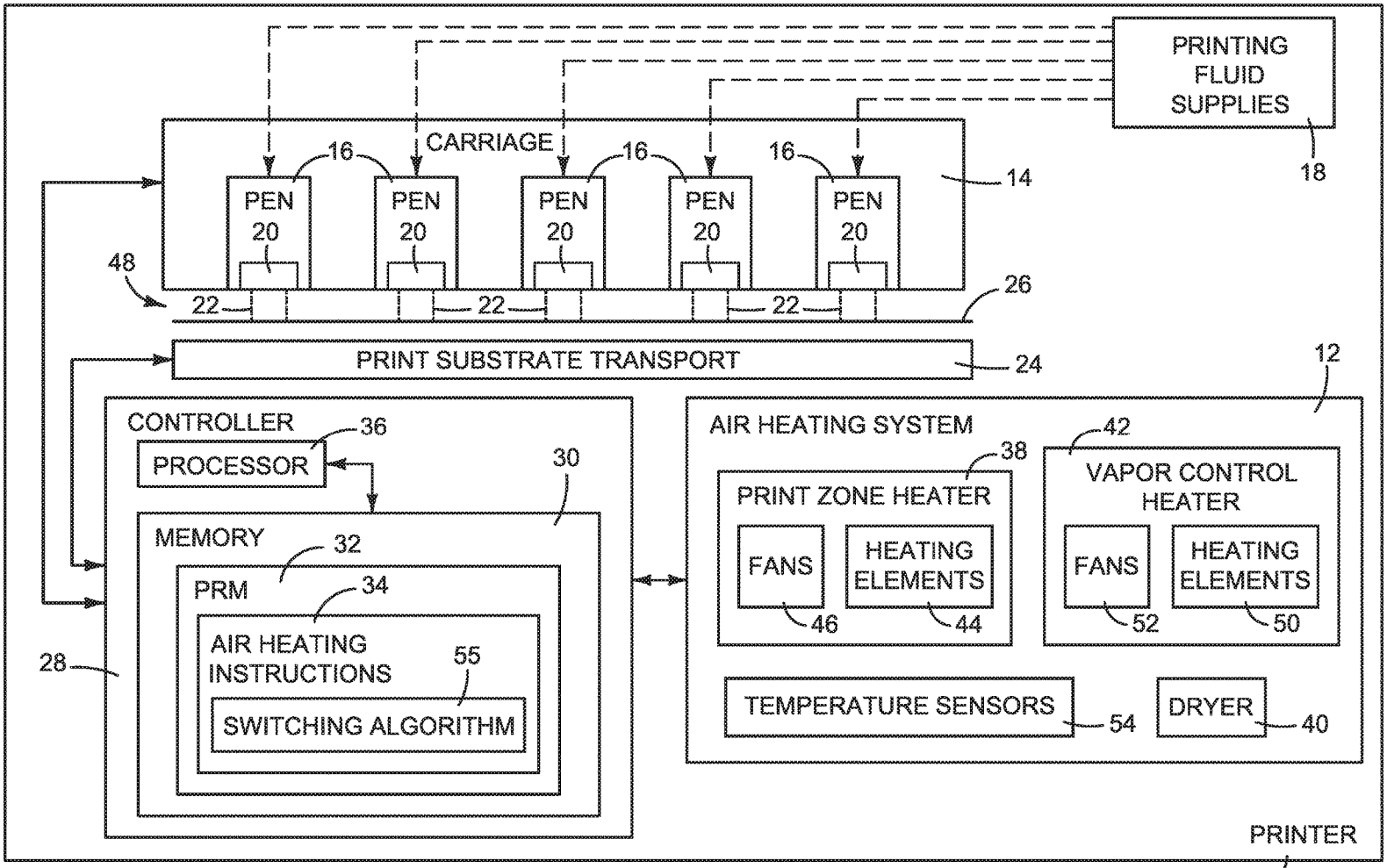
FIG. 1 is a block diagram illustrating an inkjet printer implementing one example of an air heating system with power steadying control.

FIG. 1 is a block diagram illustrating an inkjet printer 10 implementing one example of an air heating system 12. Referring to FIG. 1, printer 10 includes a carriage 14 carrying multiple ink pens 16 connected to printing fluid supplies 18. Inkjet ink pens 16 are also commonly referred to as ink cartridges or print cartridges and may dispense ink and other printing fluids from a printhead or multiple printheads 20 contained within each pen 16, for example as drops or streams 22. A transport mechanism 24 advances a paper or other print substrate 26 past carriage 14 and ink pens 16. A controller 28 is operatively connected to heating system 12, carriage 14, printheads 20 and substrate transport 24. Controller 28 in FIG. 1 represents the programming, processor(s) and associated memory, and the electronic circuitry and components needed to control the operative elements of printer 10. In particular, controller 28 includes a memory 30 having a processor readable medium (PRM)

32 with instructions 34 for controlling the functions of heating system 12, and a processor 36 to read and execute instructions 34.

A scanning carriage 14 with pens 16 illustrates just one example of a printhead assembly that may be used with air heating system 12. Other types of printhead assemblies are possible. For example, instead of ink pens 16 with integrated printheads 20 shown in FIG. 1, the printhead(s) could be mounted separately on carriage 14 with replaceable ink containers operatively connected to the carriage mounted printhead(s). Although remote printing fluid supplies 18 are shown, the printing fluids could be located on carriage 14 or contained within each pen 16. Also, instead of a scanning carriage 14, printhead(s) spanning a full width of print substrate 26 that remain stationary during printing could also be used.

Air heating system 12 includes a print zone heater 38, a dryer 40, and a vapor control heater 42. In this example, print zone heater 38 includes multiple resistive heating elements 44 and multiple fans 46 to move heated air into a print zone 48 where ink or other printing fluid is (or will be) dispensed from printheads 20 on to substrate 26. Also in this example, vapor control heater 42 includes multiple resistive heating elements 50 and multiple fans 52 to move heated air into the stream of air leaving the printer downstream from dryer 40. Heating system 12 may also include temperature sensors 54 associated with heaters 38 and 42 and operatively connected to controller 28 to help control the output of each heater 38, 42. Each temperature sensor 54 may be implemented in a thermostat or other temperature control device as part of system 12 or as a discrete part otherwise connected to controller 28.

As described in detail below with reference to FIGS. 7-11, each print zone heating element 44 is constructed with a predetermined resistance so that the combined resistance of a group of heating elements 44 is equal to the resistance of one of the vapor control heating elements 50. A switching algorithm 55 implemented through air heating instructions 34 residing on controller 28 delivers power simultaneously to both heaters 38 and 42 while periodically switching power, at a zero crossing, between the group of print zone heating elements 44 and the corresponding vapor control heating element to stay within the power line budget without causing unacceptable flicker.

Figure 2:
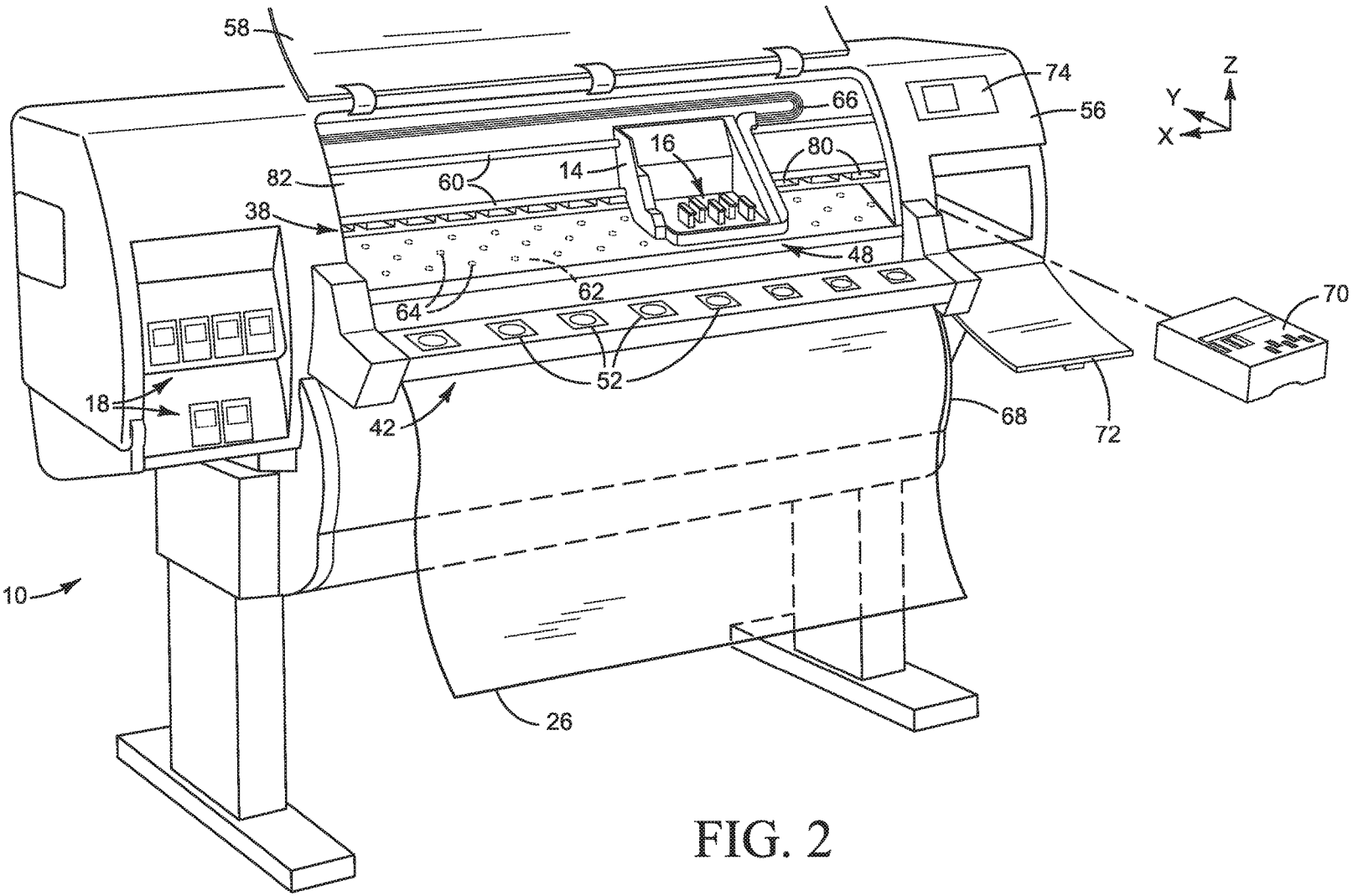
FIG. 2 illustrates a large format inkjet printer implementing one example of an air heating system such as the one shown in FIG. 1.
Figure 3:
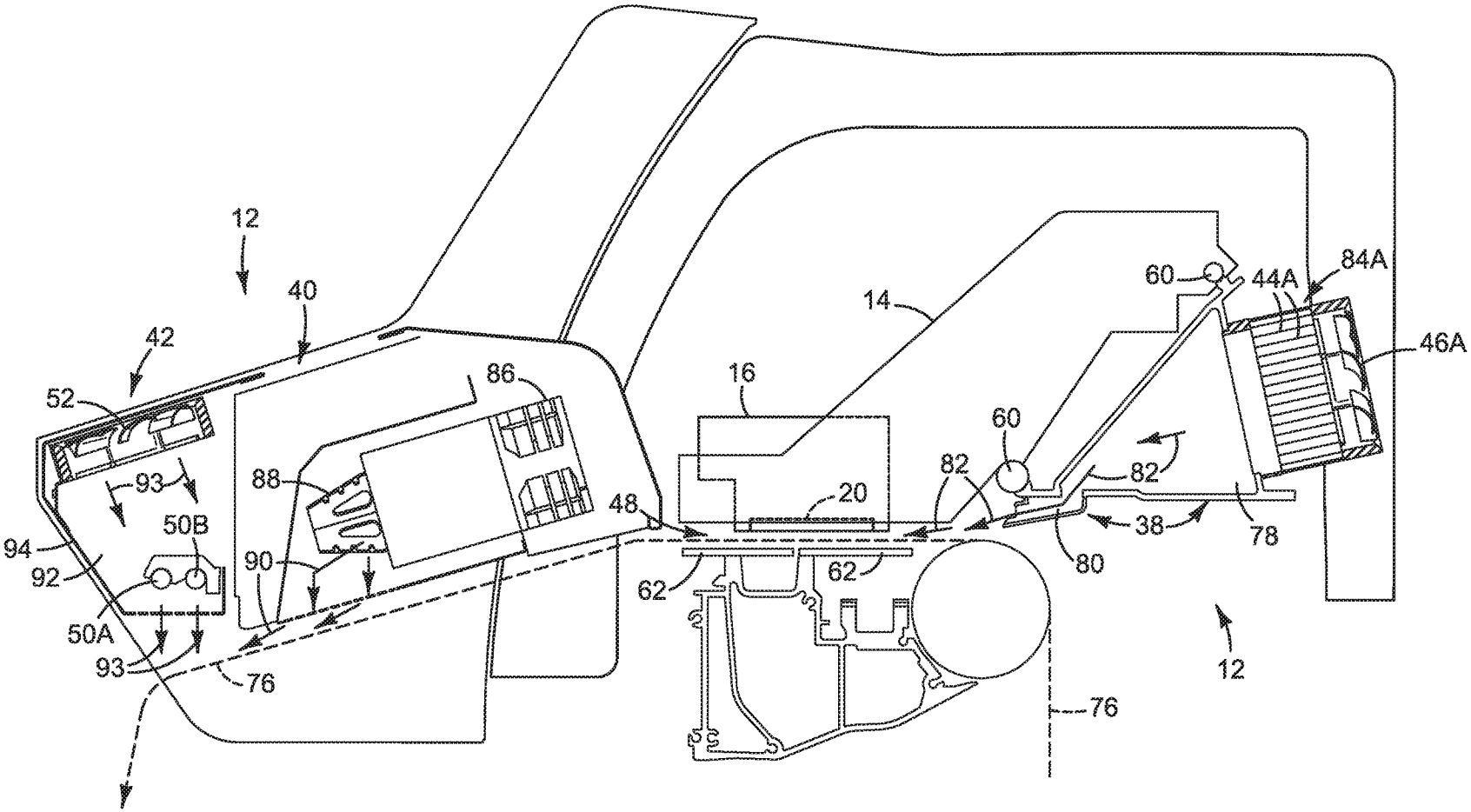
FIG. 3 is a side view illustrating the air heating system in the printer shown in FIG. 2.
Figure 4:
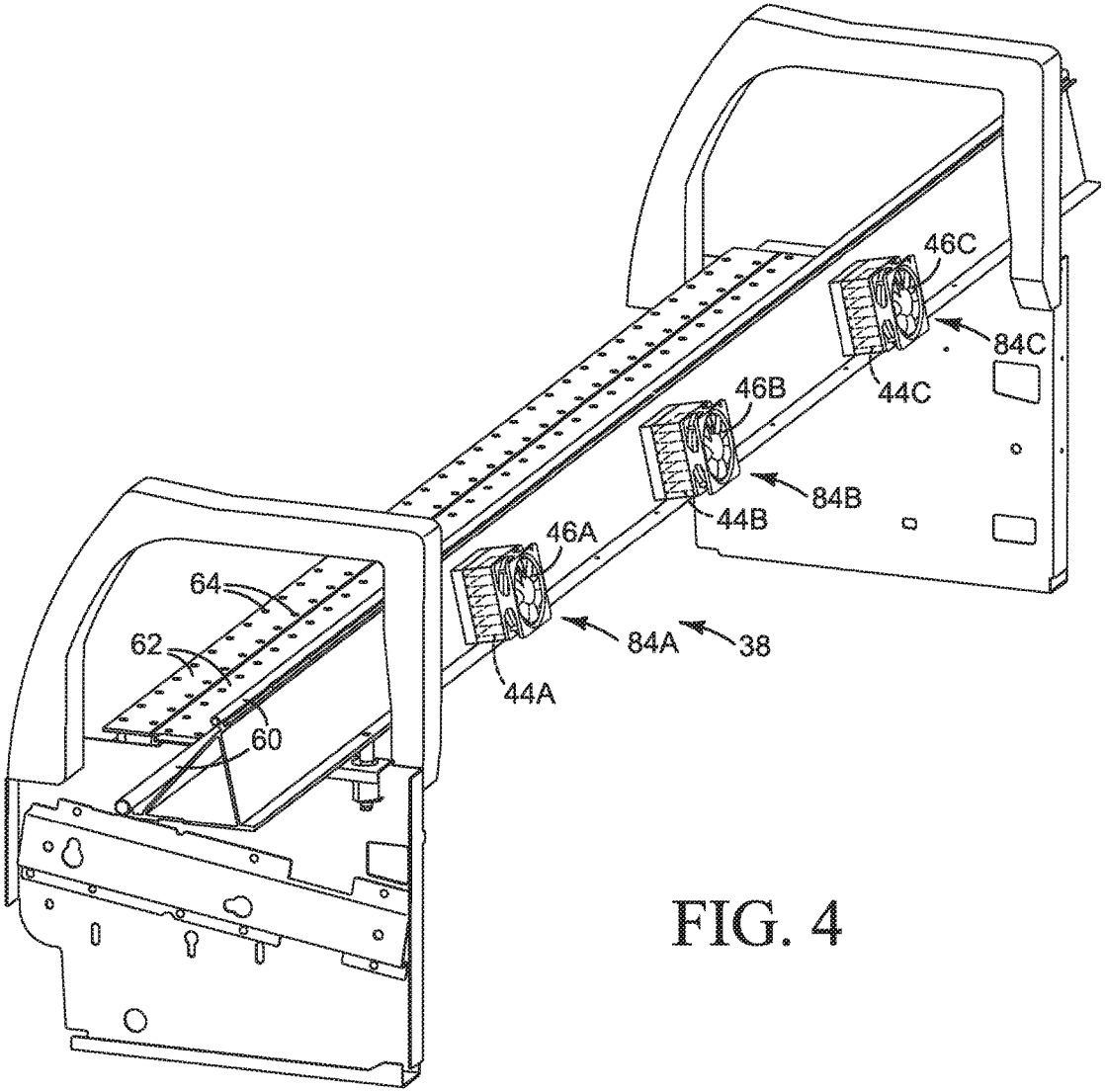
FIG. 4 is a detail view illustrating the print zone heater in the air heating system shown in FIGS. 2 and 3.
Figure 5:
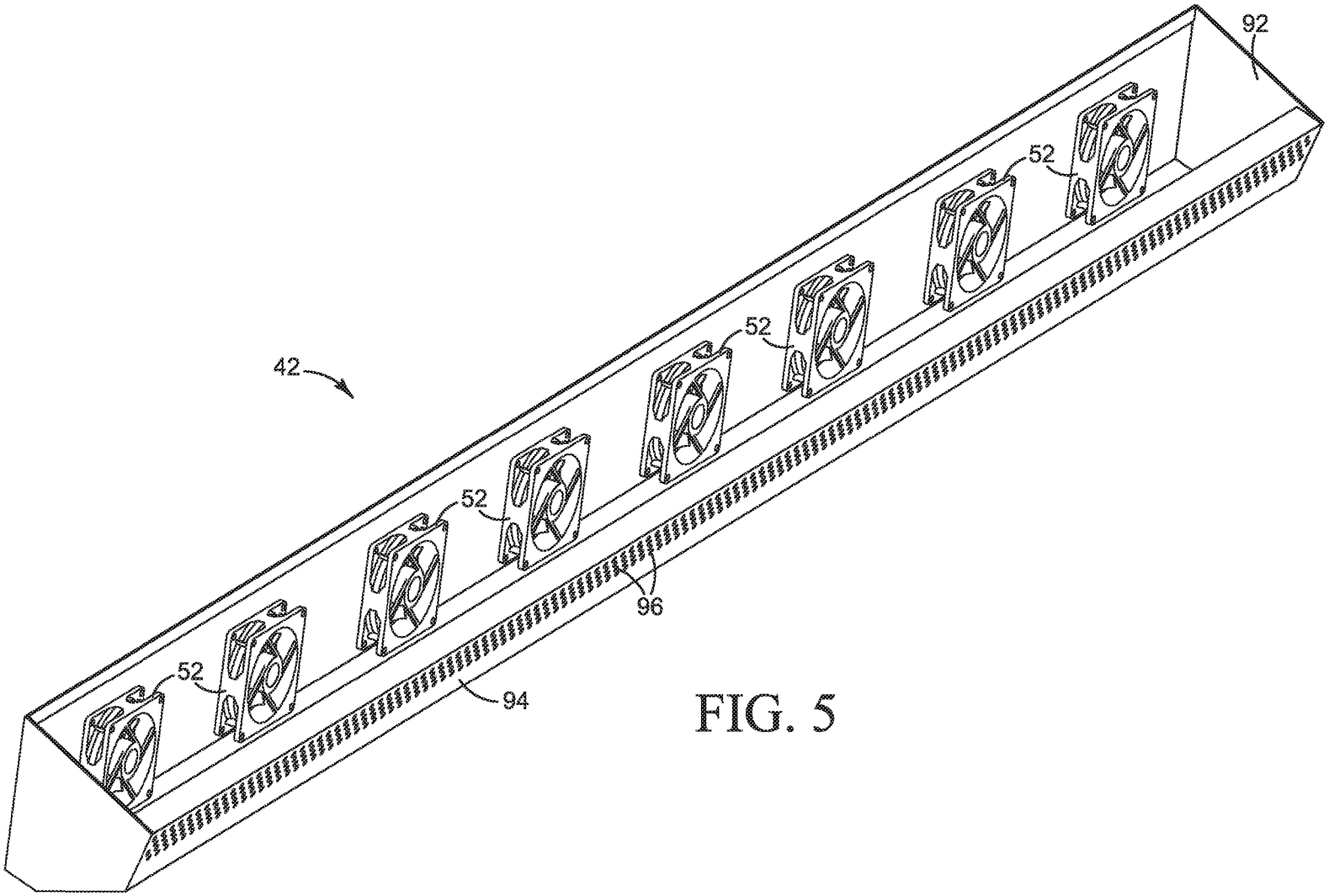
FIGS. 5 and 6 are detail views illustrating the vapor control heater in the air heating system shown in FIGS. 2 and 3.
Figure 6:
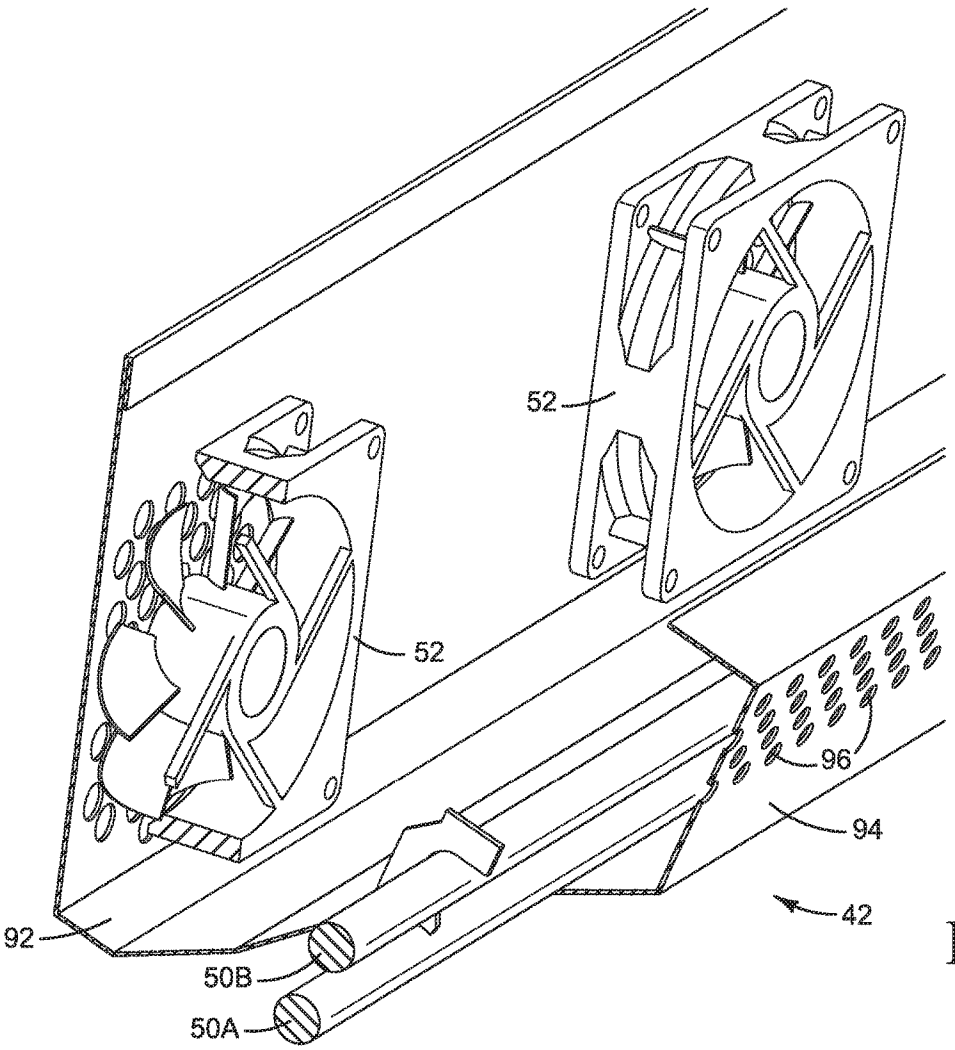

FIG. 2 illustrates a large format inkjet printer 10 implementing one example of an air heating system 12 shown in the block diagram of FIG. 1. FIG. 3 is a side elevation view of system 12 from printer 10 in FIG. 2. FIGS. 4-6 show print zone heater 38 and vapor control heater 42 in system 12 in more detail. Referring first to FIG. 2, carriage 14 carrying pens 16 is enclosed in a printer housing 56. Carriage 14 and print zone 48 may be accessed through a door 58 in housing 56. Door 58 is open in FIG. 2 to show carriage 14 and print zone 48. Carriage 14 slides along rails 60 over a platen 62. Platen 62 supports a print substrate web 26 as it passes under carriage 14 for printing with pens 16. In the example shown, platen 62 includes vacuum holes 64 connected to a vacuum system (not shown) to help hold substrate 26 flat in print zone 48. Printer 10 also includes ink supply containers 18 supported in housing 56 and connected to pens 16 through flexible tubing 66. A supply roll (not shown) of web substrate 26 is supported in a lower part 68 of housing 56. Printer 10 may also include a service module 70 at one end of platen 62 accessed through a service door 72 and a local display and control panel 74.

Referring now also to FIGS. 3-6, print zone heater 38 is positioned upstream from printheads 20 along the path 76 print substrate 26 moves through printer 10. In this example, heater 38 includes a plenum 78 and conduits 80 to carry heated air from plenum 78 to print zone 48, as indicated by flow arrows 82 in FIG. 3. Also, in this example, a discrete heating element 44A, 44B, 44C is integrated into a respective heating module 84A, 84B, 84C with fans 46A, 46B, 46C. Each fan 46A, 46B, 46C blows air over a corresponding heating element 44A, 44B, 44C into plenum 78 for distribution across the full width of print zone 48 through conduits 80. Other suitable print zone air heating configurations are possible. For example, more or fewer heating modules or heating elements and/or fans could be used.

Printer 10 also includes a dryer 40 positioned downstream from print zone 48 to dry ink and other printing fluids dispensed on to print substrate 26. In this example, dryer 40 includes a fan 86 and heating element 88 to blow hot air on to print substrate 26, as indicated by flow arrows 90 in FIG. 3. Dryer 40 usually will deliver much hotter air at much higher air flows compared to print zone heater 38, for example to quickly evaporate water from latex inks. The moisture in the hot air flowing out of printer 10 downstream from dryer 40 may condense into vapor that can produce a noticeable fog, particularly at high print volumes in cooler operating environments. Accordingly, a vapor control heater 42 may be added to introduce warm air into the moisture laden air leaving the printer to inhibit vapor condensing out of the air.

Vapor control heater 42 includes fans 52 positioned across the width of print substrate 26 to draw ambient air into a plenum 92 and blow the air over heating elements 50A, 50B and out into the moisture rich air downstream from dryer 40, as indicated by flow arrows 93 in FIG. 3. Plenum 92 is defined in part by a housing 94 that also supports fans 52. In the example shown, two elongated heating elements 50A, 50B spanning the full width of print substrate 26 are mounted along the bottom of housing 94. Air is discharged from plenum 92 through an array of holes 96 in housing 94 immediately downstream from heating elements 50A, 50B. Other suitable vapor control heating configurations are possible. For example, individual heating elements corresponding to each fan could be used, the fans could be positioned downstream from the heating element(s) to draw air through the heating element(s) into the plenum, more or fewer fans and heating elements could be used, and/or heated air could be ducted directly to the print zone without a plenum.

Figure 8:
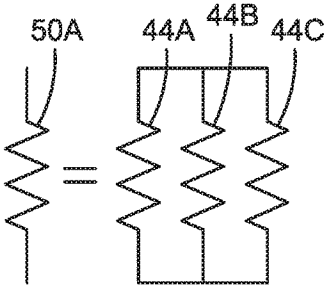
FIG. 8 illustrates one example of a relationship between resistive heating elements in the print zone and vapor control heaters in the system shown in FIG. 7.

FIG. 7 is a block diagram illustrating one example configuration for the heating elements of system 12 shown in FIGS. 1-3. Referring to FIG. 7, print zone heater 38 and vapor control heater 42 are operatively coupled to an AC power source 98 through controller 28 by a single power line 100. In this example, the three parallel print zone resistive heating elements 44A, 44B, 44C are grouped together in a group 102 with a combined, group resistance equal to the resistance one of the vapor control resistive heating elements 50A. The equivalent resistance of print zone elements 44A, 44B, 44C in group 102 and vapor control element 50A is illustrated in FIG. 8. Thus, print zone element group 102 will consume the same power as vapor control element 50A without regard to the individual resistance and corresponding power consumption of each element 44A, 44B, 44C.

The graphs presented in FIGS. 9 and 10 illustrate one example for sharing power from source 98 on line 100 between heaters 38 and 42. FIG. 9 presents a series of graphs showing the individual power consumption during inter-heater power sharing for each resistive heating element 44A-44C and 50A, 50B. FIG. 10 presents a graph showing the collective power consumption during inter-heater power sharing for heating elements 44A-44C and 50A, 50B. FIG. 11 illustrates current flow for individual heating elements 44A-44C and 50A, 50B during zero crossing switching to maintain steady power consumption on the AC power line. In the example show in these graphs, print zone heating elements 44A-44C each have the same resistance. Power consumption is depicted as an absolute value in FIGS. 9 and 10. The time period shown along the horizontal axis in FIGS. 9 and 10 may represent, for example, the time to print a single print job, part of a print job or multiple print jobs. Power is shared between heaters 38, 40 without unacceptable flicker by switching equivalent heating elements on and off at a zero crossing of the AC power.

Referring first to FIGS. 9 and 10, in this example vapor control heating element 50B is switched on at T1 and switched off at T9, remaining on for the entire time T1-T9. Vapor control heating element 50A is switched on at T1, off at T2, on at T3, off at T4, on at T5, off at T6, on at T7 and off at T8. The print zone heating elements in group 102, heating elements 44A-44C in this example, are simultaneously switched on at T2, off at T3, on at T4, off at T5, on at T6, off at T7, on at T8 and off at T9. Accordingly, as best seen in FIG. 10, total power consumption remains constant from T1 to T9.

In FIG. 11, current flow through both vapor control heating elements 50A and 50B is depicted along the top part of the graph and current flow through each print zone heating element 44A-44C is depicted along the bottom part of the graph. The AC voltage 104 is depicted with dashed lines along a horizontal time axis. Referring to FIG. 11, with both vapor control heating elements 50A, 50B on, vapor control heating element 50A is switched off and print zone heating elements 44A-44C are switched on at voltage zero crossing time T2. Accordingly, the current drawn by vapor control heater 42 drops from 50A+50B to 50B while the current drawn by print heater 38 rises from zero to 44A+44B+44C. However, because the overall resistance remains the same, power consumption on the AC power line does not change. Then, vapor control heating element 50A is switched on and print zone heating elements 44A-44C are switched off at voltage zero crossing time T3. Switching repeats in this sequence at zero crossings T4 and T5 and subsequent zero crossings to achieve the desired output from heaters 38 and 42 while maintaining uniform power consumption.

FIG. 12 is a block diagram illustrating another example of a heating system 106 with multiple heaters 108, 110 configured to maintain steady power consumption on a single AC power line. Referring to FIG. 12, heating system 106 includes a first heater 108 and a second heater 110 connected to an AC power source 98 through a controller 112. In this example, controller 112 represents a local controller that is part of system 106. Other controller configurations are possible. For example, the control functions for the heating system may be integrated into a remote controller, such as a printer controller 28 shown in FIGS. 1 and 7, or the control functions divided between local and remote controls.

First heater 108 includes resistive heating elements 114, 116 and 118. Second heater 110 includes resistive heating elements 120, 122, 124 and 126. Controller 106 includes an inter-heater control 128 for zero crossing switching between heating elements in heaters 108 and 110 to achieve the desired heat output while maintaining uniform power consumption within system 12. Controller 106 may also include an intra-heater control 130 for switching between heating elements within each heater 108, 110 as necessary or desirable to suppress flicker when only one heater is consuming power.

For inter-heater control 128 to maintain uniform power consumption, heating elements in first heater 108 or heating elements in second heater 110, or both, are grouped together to match resistance. For one example, the resistance of a single heating element 118 in first heater 108 and a group 132 of elements 120, 122 in second heater 110 are matched for switching by inter-heater control 128. For another example, the resistance of a group 134 of elements 114, 116 in first heater 108 and a group 136 of elements 122, 124, 126 in second heater 110 are matched for switching by inter-heater control 128.

Although the switching algorithm may be hard-wired into control 128, a programmable controller 112 or inter-heater control 128, or both, may be desirable in some applications to increase the flexibility of heating system 106. For example, control 128 may be programmed to match the resistance of different combinations of heating elements and determine the appropriate switching sequence dynamically to achieve the desired heating parameters while still maintaining uniform power consumption.

Controller 112 may implement switching between heaters through inter-heater control 128 as described above and switching between resistive heating elements within each heater through intra-heater control 130. For example, the diagram of FIG. 13 shows inter-heater switching 138 between first and second heaters 108, 110 when power is shared by both heaters and intra-heater switching 140, 142 within heaters 108, 110 when power is provided to only one of the heaters. Any suitable technique may be used for intra-heater switching 140, 142 including, for example, the intra-heater switching disclosed in International Patent Application No. PCT/EP2012/073270 filed Nov. 21, 2012.

While each control 128 and 130 is represented by a discrete block within controller 112 in FIG. 12, the functionality for each control 128, 130 may be implemented as a discrete microcontroller or other suitable switching and programming components within controller 112 or as part of a single integrated control unit. Also, while two heaters are shown in the examples illustrated in the figures, examples may be implemented in heating systems with more than two heaters.

FIGS. 14-16 are flow diagrams illustrating example heating system control processes to maintain uniform power consumption on an AC power line, such as might be implemented in a heating system 106 shown in FIG. 12 or a heating system 12 shown in FIGS. 1 and 7. Referring to FIG. 14, the process includes sharing AC power between first and second heaters (block 202) and switching power between a resistive heating element in the first heater and a group of resistive heating elements in the second heater while keeping the combined resistance of both heaters constant when sharing power (block 204). In FIG. 15, the control process also includes grouping resistive heating elements in the second heater together into a first group so that a resistance of the first group is equal to a resistance of the heating element in the first heater (block 206). In FIG. 16, the process also includes regrouping resistive heating elements in the second heater together into a second group so that a resistance of the second group is equal to a resistance of the heating element in the first heater (block 208).

"A" and "an" used in the claims means one or more.

As noted at the beginning of this Description, the examples shown in the figures and described above illustrate but do not limit the disclosure. Other examples are possible. Therefore, the foregoing description should not be construed to limit the scope of the disclosure, which is defined in the following claims.

What is claimed is:

1. A heating system, comprising:

a first heater having a first resistive heating element;

a second heater having multiple second resistive heating elements arranged in parallel, a group of the second heating elements having a combined resistance equal to a resistance of the first heating element; and a controller to periodically switch power between the first heating element and the group of second heating elements at a zero crossing of an AC power source.

2. The system of claim 1, wherein all of the second heating elements in the group have the same resistance.

3. The system of claim 1, wherein:

the first heater includes multiple first resistive heating elements; and the group of second resistive heating elements have a combined resistance equal to the resistance of only one of the first resistive heating elements or to the combined resistance of more than one of the first resistive heating elements.

4. The system of claim 1, wherein the group of second resistive heating elements includes fewer than all of the second resistive heating elements.

5. The system of claim 1, wherein the controller includes:

an inter-heater control to distribute AC power simultaneously to the first and second heaters and to periodically switch power between the first heating element and the group of second heating elements at a zero crossing of the AC power source; and an intra-heater control to switch second resistive heating elements on and off at zero crossings of the AC power source so that the number of second heating elements that are on at any one time remains the same.

6. An air heating system for an inkjet printer having a print zone in which printing fluid may be dispensed on to a print substrate, the system comprising:

a print zone heater to blow heated air into the print zone, the print zone heater having multiple resistive heating elements arranged in parallel;

a dryer to blow heated air on to the print substrate after printing fluid is dispensed on to the substrate in the print zone;

a vapor control heater to blow heated air into an air flow from the dryer after the air flow passes over the print substrate, the vapor control heater having multiple resistive heating elements;

a print zone heating element having a resistance equal to a resistance of a vapor control heating element; and a controller to deliver power from an AC power source simultaneously to print zone and vapor control heating elements and to periodically switch power, at a zero crossing of the AC power source, between the print zone and vapor control heating elements having the same resistance.

7. The system of claim 6, wherein:

a print zone heating element having a resistance equal to a resistance of a vapor control heating element comprises a combined resistance of all of the print zone heating elements equal to a resistance of only one of the vapor control heating elements; and a controller to switch power between the print zone heating element and the vapor control heating element at a zero crossing of the AC power source comprises a controller to periodically switch power between all of the print zone heating elements and only one of the vapor control heating elements at a zero crossing of the AC power source.

8. The system of claim 7, wherein the resistance of each of the print zone heating elements is equal to the resistance of each of the other print zone heating elements.

9. The system of claim 8, wherein:

the print zone heater includes a structure defining a plenum, a fan to move air over the print zone heating elements into the plenum, and a conduit from the plenum to carry heated air into the print zone; and the vapor control heater includes a housing at least partially enclosing the vapor control heating elements and a fan to move air over the vapor control heating elements and into the air flow from the dryer after the air flow passes over the print substrate.

10. A control process for a heating system having a first heater and a second heater, the process comprising:

sharing AC power between the first heater and the second heater; and switching power between a resistive heating element in the first heater and a group of resistive heating elements in the second heater while keeping the combined resistance of both heaters constant when sharing power.

11. The process of claim 10, further comprising grouping resistive heating elements in the second heater together into a first group so that a resistance of the first group is equal to a resistance of the heating element in the first heater.

12. The process of claim 11, further comprising regrouping resistive heating elements in the second heater together into a second group so that a resistance of the second group is equal to a resistance of the heating element in the first heater.

* * * * *